United States Patent [19]

Dean et al.

[11] 4,068,736

[45] Jan. 17, 1978

[54] METHOD AND DEVICE FOR REDUCING NOISE

[75] Inventors: Raymond H. Dean, Shawnee Mission; Michael M. Roberts, Leawood, both of Kans.

[73] Assignee: Tempmaster Corporation, North Kansas City, Mo.

[21] Appl. No.: 567,746

[22] Filed: Apr. 14, 1975

[51] Int. Cl.[2] ..... F01N 1/04; G10K 11/04

[52] U.S. Cl. ..... 181/224; 181/295; 181/252

[58] Field of Search ..... 181/33 G, 42, 50

[56] References Cited

U.S. PATENT DOCUMENTS

| | | | |
|---|---|---|---|
| 2,759,554 | 8/1956 | Baruch | 181/33 G |
| 2,802,764 | 8/1957 | Slayter et al. | 181/33 G |
| 2,830,000 | 4/1958 | Fabino | 181/33 G |
| 2,916,101 | 12/1959 | Naman | 181/42 |
| 2,950,776 | 8/1960 | Stephens | 181/42 |
| 2,958,387 | 11/1960 | Greff | 181/42 |
| 3,037,578 | 6/1962 | Jack | 181/33 G |
| 3,263,771 | 8/1966 | Seifert | 181/33 G |
| 3,274,046 | 9/1966 | Shannon et al. | 181/33 G |
| 3,353,626 | 11/1967 | Cremer et al. | 181/42 |
| 3,642,093 | 2/1972 | Schach | 181/33 G |

*Primary Examiner*—Stephen J. Tomsky
*Attorney, Agent, or Firm*—Lowe, Kokjer, Kircher, Wharton and Bowman

[57] ABSTRACT

A device for reducing noise interiorly of air distribution ducts is comprised of at least one sound attenuating module which is adapted to be placed adjacent to a noise source or installed interiorly of conventional air distribution ducts. The module has a plurality of adjacently sandwiched glass fiber layers which are separated from each other by aluminum side walls. Each one of the layers is sealed by an aluminum membrane enclosure (with the outer membranes being substantially airtight to prevent any resultant friction between air passing through the duct and the glass fiber). Noise is reduced as the sound pressure (developed by the conditioned air flow in the duct) alternately contracts and expands the compliant glass fiber media interiorly of the module, thusly dissipating energy in the form of friction between the glass fibers that are in each layer. To reduce acoustic input impedance at the low frequencies, the layers are made approximately one quarter wavelength thick, thereby enabling the ordinarily high wall impedance to be transformed into a lower acoustic impedance at the outside surface thereof. However, in order to minimize necessary module thickness, the wavelength of the noise frequency of interest is decreased by reducing the speed of sound through the absorber.

A method for attenuating predetermined noise frequencies comprises the steps of using a compliant sound absorption media having a thickness of approximately one quarter of the wavelength of a sound frequency to be attenuated, sealing at least a portion of said media within a flexible air impervious membrane, and locating said sealed media in operative proximity to said noise.

21 Claims, 7 Drawing Figures

Fig. 1.
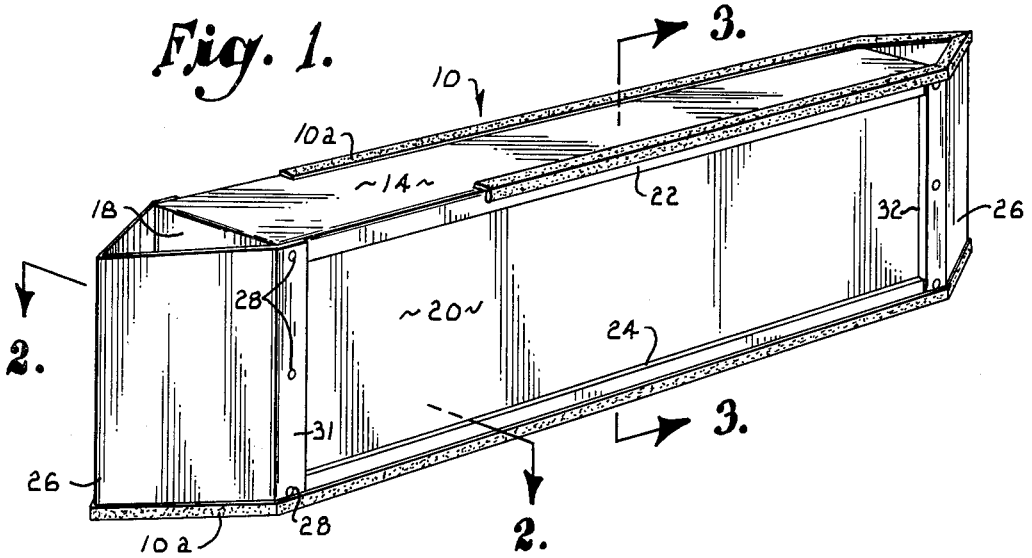
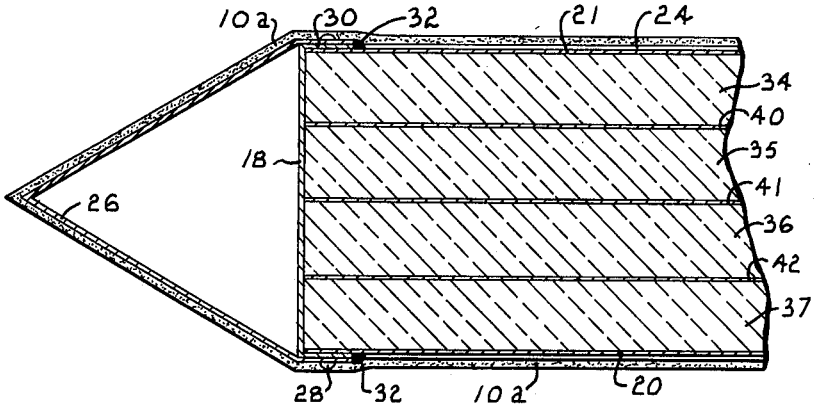
Fig. 2.
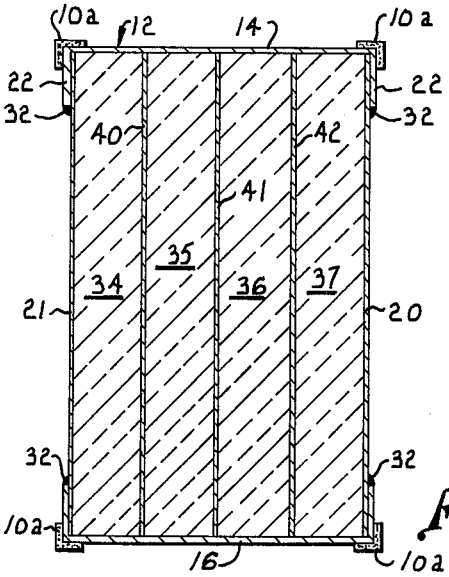
Fig. 3.
Fig. 4.
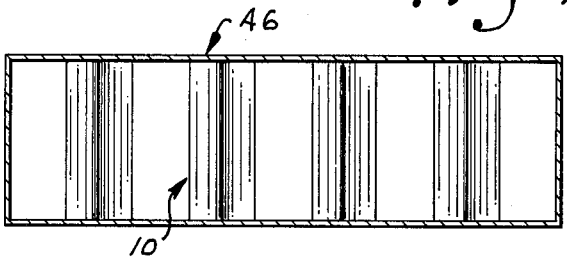

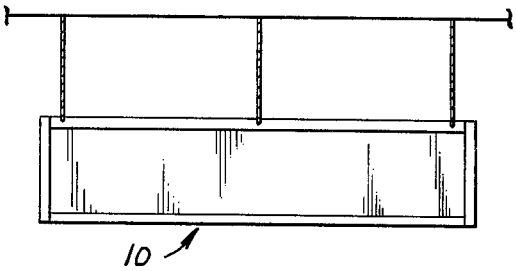
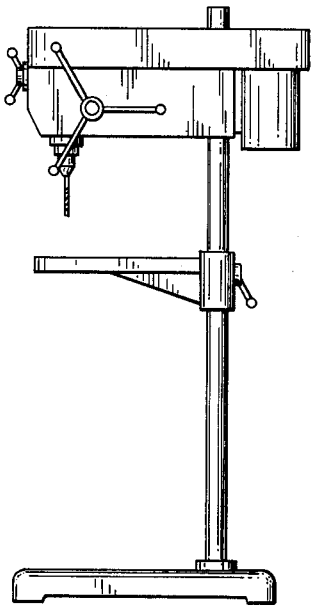
Fig. 5.
Fig. 6.
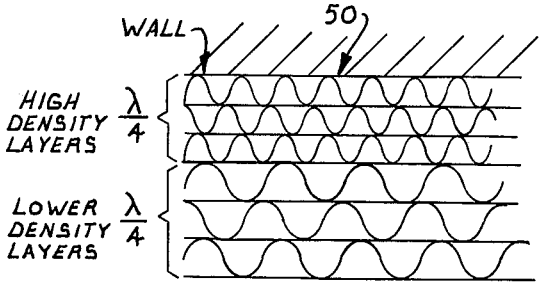
Fig. 7.
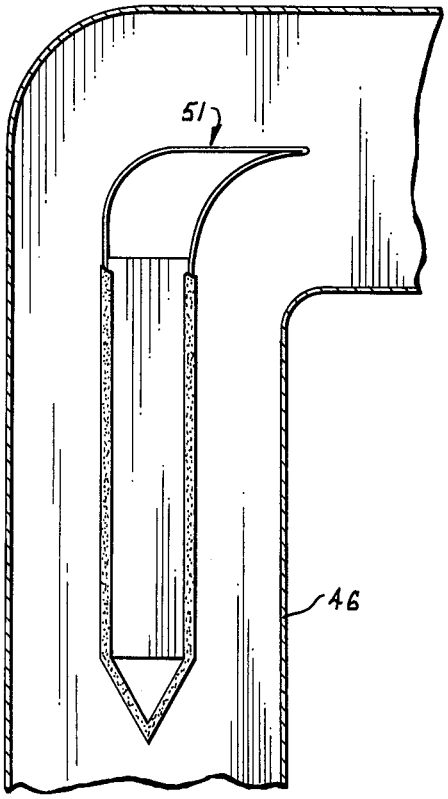

METHOD AND DEVICE FOR REDUCING NOISE

BACKGROUND AND SUMMARY OF THE INVENTION

This invention relates to a method and device for reducing noise adjacent the source thereof in air distribution systems. More particularly the apparatus comprises one or more sound attenuating modules which may be located near a noise source such as noisy machinery or added to conventional air distribution ducts. The method comprises the steps of constructing and employing the said device in a unique fashion to reduce noise.

The background and known prior art is best summarized in a book by Leo L. Beranek, entitled "NOISE REDUCTION" and published in 1960 by McGraw-Hill Book Company, Inc.

Modern air conditioning systems generate objectionable noise in a variety of ways. The most significant source of such noise emanates from the system fan which can produce a relatively low frequency hum as it forces air into or out of the associated ventilation system. Similarly, air conditioning apparatus such as cooling towers and compressors likewise can contribute to noise production through mechanical vibration. Turbulence generating discontinuities within distribution ducts, caused, for example, by right angle bends, mixing boxes, heat exchangers and other apparatus, can produce objectionable noises as air rushes through the system. Often the areas or rooms receiving conditioned air contribute to the noise problem by introducing sounds (from conversation or typing, for example) into the distribution network via the terminal duct in the particular room.

Prior art noise reduction systems are known to employ glass or mineral wool fiber layers interiorly of ventilation ducts to absorb sounds from the air rushing therethrough. Sound energy is dissipated as acoustically excited vibrating air particles rub against relatively stationary exposed glass fiber or mineral wool strands. Fibrous material is normally placed on the interior sides of the ducts and, where desirable, at the center portions thereof. In one common form of prior art noise reducer, glass fiber material or mineral wool is housed within a perforated metal enclosure so that acoustically excited air particles may pass therethrough to contact the glass fiber as the relatively steadily flowing air passes along the surface. Each housing is located interiorly of a specially designed noise reduction duct which usually must be installed in series with an existing duct to reduce noise. The sound absorbing media may be positioned either against the side walls of the duct or spaced between the sidewalls, or both.

The above-mentioned prior art noise reduction devices are disadvantageous in several respects. Installation of these devices often necessitates special sheet metal fittings to adapt the housing to the main duct system, resulting in the usual delay and expense associated therewith. Since the rough glass fiber noise dampening material contacts the air running through the duct system, air friction is increased. Consequently a larger (and usually noisier) fan must be employed to maintain a given air flow through such a system. As a corollary thereto, the exposed glass fiber will tend to filter or absorb particles or vapors carried by the air passing through it or by it. By way of example, prior art systems in hospitals, laboratories and the like tend to collect germs or fungus. Similarly, when such systems are used in machine shops, they tend to accumulate a variety of petroleum vapors. Besides contributing to environmental hazards in the manner just described, various particles and foreign material absorbed by the glass fiber inevitably decrease noise reduction capabilities by inhibiting the passage of acoustically excited vibrating air particles. In high velocity air distribution systems, friction between the glass fiber sound absorbing material and air rushing thereby can lead to deformation of the glass fiber panels. Furthermore, where perforated metallic housings are used to reduce glass fiber deformation, additional high-frequency noise can actually be generated as air rushing by the perforations creates a variety of "whistling" or "rushing" sounds. Also, the perforations eventually tend to clog as airborne material is deposited therein.

The present invention includes a unique method and device for reducing noise which obviates the aforementioned problems. The device comprises a noise reduction module which may be located adjacent the noise source (factory machines and the like) or easily inserted interiorly of an existing air duct by sliding it therein and fastening it to the duct by sheet metal screws. The module comprises a plurality of compliant glass fiber sheets for absorbing and dissipated unwanted sound energy, but unlike prior art devices the glass fiber does not contact the air passing through the duct. Instead, a plurality of sandwiched glass fiber sheets are completely and sealable housed within a thin metallic airtight enclosure. Each internal sheet is separated from the adjacent sheets(s) within the enclosure by a similar impermeable membrane. When located in a duct, a generally triangular or wedge shaped member is provided at each end of the module to reduce air turbulence as the conditioned air passes around the module.

In general the shape of the module may be modified and its dimensions can be varied, where necessary to accomodate duct work of varying sizes and shapes. Thus the normally rectangular module can be adapted for use with round, oval or other irregularly shaped ducts. Also, modules can be located near right angle turns or bends and modified with turning vane end members for accordingly reducing objectionable noise normally produced by the duct angles.

The compliant glass fiber sheets in the module alternately contract and expand in response to noise caused by compression and rarefaction of the air passing through the duct or around noisy equipment. Sound energy is dissipated, for example, in the form of internally generated heat as the glass fiber sheets are alternately compressed and expanded. Since the walls (foil membrane) of the module are smooth and lightweight and further since the moving air through a duct does not contact the glass fiber, frictional air stream losses are minimized to thereby provide a noise reduction system of improved efficiency. Importantly, the acoustic impedance of the module at the frequency to be attenuated is minimized by presenting an acoustic path equal in length to approximately one quarter wavelength of the frequency to be attenuated. Thus, unlike known prior art sound absorbers, acoustical "matching" is employed by the present invention in a manner acoustically equivalent to principles of electrical transmission line theory.

The media is "matched" to the air outside of the device when the reactances contributed by the mass and compliance cancel to present a net reactance of zero to the impinging sound wave, and when the various resistances in the media combine and are transformed by the reactances to present a net resistance equal to the characteristic resistance of air.

The subject method comprises, in part, the steps of selecting at least one preferably glass fiber layer having a total thickness approximately equal to one quarter wavelength of the sound frequency to be attenuated, sealing the layer within the airtight membrane having at least one flexible wall portion adjacent the layer, thereby forming a noise attenuating module, and locating the module adjacent a source of noise or installing same interiorly of the air distribution ductwork. Where necessary, space can be conserved by the additional step of increasing the density (within limits) of the glass fiber layer to reduce the velocity of sound wave therethrough, thereby reducing the equivalent acoustical quarter wavelength at the frequency of interest. In any event, the aforementioned method does not contemplate laborious sheet metal modifications of or additions to existing air distributing apparatus.

Thus, a primary object of this invention is to provide a unique noise reduction method and device which has particular utility with air distribution systems.

A further object of this invention is to provide a noise attenuating method and device of the character described which can easily and quickly be utilized in conjunction with existing duct work without complex sheet metal alterations.

It is also an object of this invention to provide a compact and efficient noise attenuation module for air distribution ducts. It is an important feature of the invention that more than one module may be conveniently installed in a spaced relationship, if needed. Accordingly, manufacturing costs may be reduced since the total noise reducer can comprise one or more modules at a single location, obviating the need for custom designs.

Another object of this invention is to provide a noise reduction device of the character described which, upon installation, presents negligible airstream resistance.

A further object is to provide a unique device for reducing noise which may be operatively positioned adjacent to a noise source in an easy and convenient manner. It is a feature of the invention that the device may be effectively hung or located near noisy machinery and the like to reduce the level of noise that an operator would normally experience.

A related object of this invention is to provide a noise reduction device of the character described above in which glass fiber dampening material is adapted to reduce noise without directly contacting the air passing through the vent.

Another object of this invention is to provide a noise reduction module having optimal acoustic input impedance at the noise frequencies of interest and to further provide a method for reducing heretofore excessively high acoustical impedance at low frequencies.

Yet another object of this invention is to provide a noise reduction module of the character described which will attenuate a relatively wide range of noise frequencies. It is a feature of the invention that multistage "matching" networks can be formed by using properly selected different density layers within the module. Further, glass fiber layers of different densities can be employed in adjacent modules to simultaneously attenuate different noise frequencies.

A still further object is to provide a noise reduction module which can be varied in size and shape to suit a variety of installations. It is a feature of the invention that the module may be in the form of a cowling located around a fan unit, a rectangular device of the type described, or arcuately shaped for air turning purposes as well as noise reduction.

Yet another object of this invention is to provide a noise reducing module having the attributes and features mentioned aove which is rugged, dependable and long lived.

Other and further objects of this invention will occur in the course of the following detailed description.

DESCRIPTION OF THE DRAWINGS

In the accompanying drawings, which form a part of the specification and are to be construed in conjunction therewith, and in which like numerals are employed to represent like parts in the various views:

FIG. 1 is a perspective view of a modular noise attenuator constructed in accordance with the teachings of this invention;

FIG. 2 is a sectional, fragmentary view of the attenuator taken along line 2—2 in FIG. 1;

FIG. 3. is a sectional view of the attenuator taken along line 3—3 in FIG. 1;

FIG. 4 is an end view of a conventional air distribution duct in which a plurality of attenuators (constructed in accordance with the teachings of this invention) are mounted;

FIG. 5 is a schematic showing of the noise attenuator being located adjacent objectionable noise producing machinery;

FIG. 6 is a diagram of a possible multi-stage (two) impedance matching arrangement for sound absorption over a wide frequency range; and FIG. 7 is a schematic view of a module being used with a turning vane in an air duct.

Turning now to FIGS. 1-3, one embodiment of a modular noise attenuator 10 comprises a longitudinally extending body portion 12 of generally rectangular cross sectional area. Body 12 comprises upper and lower rectangular sheet metal surfaces 14 and 16, respectively, which may be integral with a front, sheet metal end portion 18 and a rear sheet metal end portion (not shown). The side portions of body 12 (which will be discussed in more detail later) comprise relatively thin metallic sheets (fiber reinforced aluminum foil or similar air impervious membrane) 20 and 21 which are maintained in generally perpendicular alignment with respect to surfaces 14 and 16 by vertically bent flange portions 22 and 24, which integrally extend from the edge portions of surfaces 14 and 16, respectively. A generally triangular wedge shaped sheet metal end member 26 which acts as a turbulence reducer is fastened at each end of body 12 by screws (or other suitable means) 28 anchored within flange portions 22, 24 and 30. The inner transverse edges 31 of each end member 26 abut a silicone seal 32 which is provided to maintain an airtight enclosure and to lend additional structural support to keep the glass layers from being dislodged, etc.

The outside edges of the module have foam rubber gasket strips **10*a*** affixed thereto for the purpose of damping vibrations and to prevent rattling when located within the air duct. Actually, when the module is installed interiorly of the duct, it also acts as an internal stiffener or mechanical support for the duct itself.

Sealed interiorly of body 12 are a plurality of preferably glass fiber sound dampening layers 34–37. Layers 34–37 are stacked in generally parallel relationship and separated from each other by thin paper backed aluminum sheets 40–42 similar to the outer walls 20 and 21 mentioned above. The sheets or foil membranes (20, 21 and 40–42) provide an airtight seal (with the outside membranes being airtight, the imperviousness of membranes 40–42 is not critical) between adjacent glass fiber layers but are sufficiently flexible to facilitate the transmission of sound vibration. It has been found that utilization of a membrane (paper backed foil) weighing about 0.03 lbs./ft$^2$ operates in a satisfactory fashion and gives the desired results when used with glass fiber layer(s) having a suitable density (approximately 1.5 lbs./ft$^3$ glass fiber for quarter wavelengths $\lambda/4 = 3$ inches) and resilience for fiber-to-fiber friction sound absorption.

The resistance of a simple glass fiber media is commonly determined by the well known flow resistance measurements. With a simple glass fiber media, the flow resistance should be set approximately equal to the characteristic resistance of air. However, when the subject composite media is excited by an impinging sound wave, an additional mechanism, fiber to fiber friction, must be considered as well. Moreover, consideration of the way in which the subject composite media will respond to an impinging sound wave makes it clear that the value of the glass fiber's resistance should be approximately twice as high as it would have to be if the media was simply glass fiber alone. Since it is relatively difficult to attain high glass fiber resistance and simultaneously maintaining compliance, attention must be directed to this detail during manufacture.

One or more modular sound attenuators can be installed in an existing air distribution duct 46 (FIG. 4) simply by inserting them in the duct and securing them by sheet metal screws (or other suitable fastening means) in the desired position. The longitudinal axis of each attenuator should be oriented substantially parallel to the direction of air flow. Also, spaces between adjacent modules (and from a module to the duct side wall) should be approximately equal. These spaces can be less than or greater than the module width, depending on how much sould absorption length is desired. In this manner turbulence is minimized by the wedge shaped end members and additional module or duct modification is not necessary. Furthermore, the conditioned air will pass by the smooth surfaces (20 and 21) of each attenuator module in a substantially unimpeded fashion so that losses and any substantial efficiency drop will thereby be avoided. Since the interior glass fiber layers are sealed within an airtight membrane, contact (and airstream resistance) with air passing by (and more particularly the particles of vapors carried thereby) will be avoided.

As shown in FIG. 5, the attenuator modules may be conveniently hung (either singly or in a cluster) over a noisy machinery. In this manner the operators of the machines located in close proximity will experience some relief and lower noise levels may be obtained at specific locations within a shop.

THEORY OF OPERATION

The subject invention has particular utility in attenuating unwanted noise that may appear in the 2nd, 3rd and 4th octave bands (125Hz, 250Hz and 500Hz). Higher frequencies are easily attenuated by other devices (e.g. duct liner, terminal units, etc.) that are typically found in prior art air distribution systems and are therefore not a primary concern. However, the basic invention applies a combination energy absorption mechanism with impedance matching techniques.

It has been found that sound being propagated through the air in the duct will be attenuated by alternately compressing and expanding the layers of glass fiber. The outer membrane (preferably reinforced aluminum foil) surface layers 20 and 21 (as well as the interior walls 40, 41 and 42) must be sufficiently thin to faciliate the transmission of sound. Nonetheless, the membrane (and seal) must be sufficiently strong to preserve the airtight integrity of the enclosure. Sound attenuation occurs as acoustic energy is dissipated by the glass fiber strip(s) 34–37 in the form of fiber-to-fiber friction. The resiliency of the strips 34–37 must be sufficient to allow proper air-cushion spring action. For example, it should require sufficiently less pressure to compress unsealed glass fiber strip(s) than to compress a sealed air bag of equal dimensions.

The acoustic input impedance of the module at the frequencies of interest is minimized by an acoustic "matching" technique. Accordingly, the distance between the outside wall portion 20 (or 21) and the inner, center wall portion 41 is chosen such that an acoustical quarter wavelength is presented. By analogy to electrical transmission line theory, a quarter wavelength transmission line will transform a high termination impedance into a low impedance at the outside surface thereof. The dimensions of the glass fiber layers here are chosen so that any "high wall" acoustic impedance ordinarily "sensed" from interiorly of the module, is transformed (by the aforementioned quarter wavelength technique) into a low acoustic input impedance at each of the outer wall portions 20 and 21. Thus the width of the attenuator in the preferred embodiment is approximately equal to an equivalent one half wavelength. However, in certain instances such as where low noise frequencies are encountered, it is usually desirable to employ an attenuator having an "equivalent" width of one quarter wavelength (having only one or two fiber glass layers for example). Space and economic limitations will usually not permit quarter wavelength thicknesses of several feet as a 3rd octave (250Hz) might dictate. Since a wavelength is equal to the velocity of sound divided by frequency ($\lambda = c/f$) it is possible to reduce the wavelength by reducing the velocity (speed) of the sound below what it is in air (e.g. 1130 ft./sec.). It has been found that the more dense the glass fibers, the slower the velocity of sound therethrough. Consequently, by increasing the density of the glass fiber layers the thickness necessary to approximate an acoustical quarter wavelength decreases. An analogous situation exists with electrical transmission lines because of the reduced velocity of propagation therethrough. Thus, for example, an electrical quarter wavelength of transmission lines will not physically correspond in distance (e.g. lines having more series inductance and parallel capacitance per unit length are shorter).

It is well known that wave length, $\lambda$, of sound having a frequency, $f$, is given by the formula $\lambda = s/f$. The speed of sound, S, may be approximated by the formula $S=\sqrt{1/MC}$ where M is the effective mass of media carrying the sound and C is compliance of the air or the media structure whichever is smaller (in appropriate units). From the above, it is apparent that the speed of sound in the subject composite media is less than the speed of sound in air, and is less than the speed of sound in a simple glass fiber media, and less than the effective average speed of sound implied by the use of an unattached membrane in close proximity to a simple glass fiber media. By intimately attaching the membrane to the glass fiber, the speed of sound is reduced in the composite media in that the entire mass of the glass fiber is forced to be carried along with the sound wave thereby increasing M in the above expression from being approximately equal to the mass of air to being approximately equal to the mass of glass fiber.

As was suggested above, multi-stage "matching" networks can be formed by using properly selected different density layers in the module or grouping. FIG. 6 shows a hard wall 50 having a two stage impedance match arrangement located thereon for sound absorption over a wide range. The layers adjacent the hard wall 50 are constructed of high density glass fiber and sized for quarter wavelength reflection. The outer layers are comprised of lower density glass fibers also a quarter wavelength thick. Such a sound absorbing media is suitable for location on the side wall of a room or on a panel and is a small and effective noise attenuator.

The subject invention and construction is not limited in size or shape and/or the type of equipment of ductwork used therewith. The basic concept of the sound reducer or attenuator may be used with round, oval, rectangular or square ducts. It has environmental inertness due to the outer foil membranes and associated seal. Accordingly, it is both water and air tight and can be used out of doors and with cooling towers as well as inside near machinery or in a hosital or in other volatile atmospheres or on the surfaces of sound absorbing walls or panels. It can be used with turning vanes in air ducts (see turning vanes 51 in FIG. 7) and blowers and reduces friction losses normally occurring with known glass fiber sound attenuators.

From the foregoing, it will be seen that this invention is one well adapted to attain all of the ends and objects hereinabove set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. A device for reducing substantially low frequency noise occurring or transmitted within the operating proximity thereof, said device comprising a compliant sound absorption composite media, said media having an exposed fibrous structure and an acoustical resistance capable of dissipating sound energy therein from said noise by the fibrous media interaction, said composite media including an air impervious compliant membrane attached to and enclosing said exposed structure, said composite media further having a combined membrane and fibrous structure thickness that is substantially equal to a quarter wavelength in the media for the frequency of the undesirable noise, the air external to said composite media having a characteristic resistance to sound, the acoustical resistance of said media being substantially matched to said external air characteristic resistance at said undesirable noise frequency, and means for supporting said media in proximity to said noise without substantially altering the acoustical wavelength and the acoustical resistance of said media.

2. The device as in claim 1 wherein said media is divided into a plurality of layers of glass fiber.

3. The device as in claim 2 wherein said device includes a rigid metal housing operable to enclose at least a portion of said media, said housing having an opening defined in at least one side thereof to expose a substantial portion of said membrane enclosed media therethrough.

4. The device as in claim 3 wherein said housing has at least two openings defined therein to expose substantially all of at least two surface areas of said membrane enclosed media, and said housing having a means for reducing turbulence in an airstream passing by said device located on at least one end thereof.

5. The combination as in claim 1 including an air distribution system having an air duct, and means for mounting said device interiorly of said air duct.

6. The combination as in claim 5 wherein a plurality of said devices are mounted interiorly of said air duct and wherein said devices are spaced a preselected distance apart across the width of said air duct.

7. The combination as in claim 5 wherein said media is divided into a plurality of layers of glass fiber.

8. The combination as in claim 7 wherein at least one of said layers has a total thickness approximately equal to one quarter of the wavelength of a sound frequency to be attenuated.

9. The combination as in claim 2 wherein said device includes a rigid metal housing operable to enclose at least a portion of said media, said housing having an opening defined in at least one side thereof to expose a substantial portion of said membrane enclosed media therethrough.

10. The combination as in claim 9 wherein said housing has at least two openings defined therein to expose substantially all of at least two surface areas of said membrane enclosed media, and said housing having a means for reducing turbulence in an airstream passing by said device located on at least one end thereof.

11. A method for attenuating predetermined noise frequencies, said method comprising the steps of constructing a compliant sound absorption media having air exposed fibrous structure and an acoustical resistance capable of dissipating sound energy therein from said noise frequencies by fibrous media interaction, enclosing a portion of said structure of said composite media with an intimately attached compliant air impervious membrane, said composite media having a combined membrane and fibrous structure thickness substantially equal to a quarter wavelength for the undesirable frequency of the noise within the media, acoustically matching the acoustical resistance of said media to the external air characteristic resistance to sound at said undesirable noise frequency when said composite media is backed by a hard surface locating said composite media in operative proximity to said noise; and supporting exposed portions of said media in proximity to said noise in such a manner that the acoustical wavelength and the acoustical resistance of said media are not substantially altered.

12. The method as in claim 11 wherein said locating step includes the additional step of positioning said sealed media within an air duct.

13. The method as in claim 11 wherein said locating step includes the additional step of positioning a plurality of said sealed media within an air duct.

14. The method as in claim 11 including the step of dividing said media into a plurality of layers with at least one layer having a thickness approximately equal to one quarter of the wavelength of a frequency to be attenuated.

15. The method as in claim 14 wherein said locating step includes the additional step of positioning said sealed layers of said media within an air duct.

16. The method as in claim 14 wherein said locating step includes the step of positioning said sealed layers adjacent a wall or panel.

17. The method as in claim 16 including the step of locating layers of said media having different thicknesses for different sound frequency attenuation adjacent a wall or panel.

18. The method as in claim 15 including the step of positioning a turning vane on at least one end of said media to effect the turning of an air stream within an air duct.

19. The method as in claim 11 including the step of reducing the speed of the sound to be attenuated thereby effecting a reduction of the wavelength associated with the frequency of said sound.

20. The method as in claim 19 including the step of dividing said media in layers, at least one of said layers having a thickness equal to approximately one quarter of the reduced wavelength.

21. The method as in claim 11 wherein said locating step includes the step of positioning said sealed layers adjacent a wall or panel.

* * * * *